United States Patent [19]

Cunningham

[11] 4,012,007

[45] Mar. 15, 1977

[54] PAPER TOWEL HOLDER

[76] Inventor: Donald W. Cunningham, 1403 S. Dudley St., Lakewood, Colo. 80226

[22] Filed: Aug. 1, 1975

[21] Appl. No.: 601,247

[52] U.S. Cl. ..... 242/55.54; 248/206 R

[51] Int. Cl.[2] ..... A47K 10/24; A47K 10/32

[58] Field of Search ..... 242/55.54, 55.2, 55.42, 242/55.3, 55.53, 55.55, 129.5, 129.7, 129.71; 248/206 R

[56] References Cited

UNITED STATES PATENTS

| | | | |
|---|---|---|---|
| 122,890 | 1/1872 | Hodgkins | 248/206 R |
| 952,495 | 3/1910 | Austin | 248/206 R |
| 1,224,106 | 4/1917 | Good | 242/55.54 |
| 2,641,415 | 6/1953 | Moriarty | 242/55.2 |
| 3,240,461 | 3/1966 | Singleton | 248/206 R |
| 3,622,010 | 11/1971 | Renelt | 242/55.54 |

*Primary Examiner*—George F. Mautz
*Attorney, Agent, or Firm*—C. B. Messenger

[57] ABSTRACT

A holder for the convenient dispensing of rolled paperr towels and the like. A standard of size to closely engage the interior of the tube core for the roll of paper extends outwardly from a base support that is adapted for engagement with various support surfaces disposed near points of use for the towels. The hollow base has widely spaced apart sidewalls that enclose a centrally disposed suction cup with edges of said sidewall being selectively held in contact with the support surface by vacuum influences induced by said suction cup to provide stability for said holder, its standard and any roll of paper towels disposed thereon. A mechanism on said standard that is interconnected to said suction cup induces or relieves the vacuum influences when the holder is being placed or removed. The holder is intended primarily for use with the base disposed on horizontal surfaces and the standard and roll of paper towels in upright position with adequate support being provided by said base and suction cup so the tearing of individual towels from the roll is a single-handed operation.

9 Claims, 4 Drawing Figures

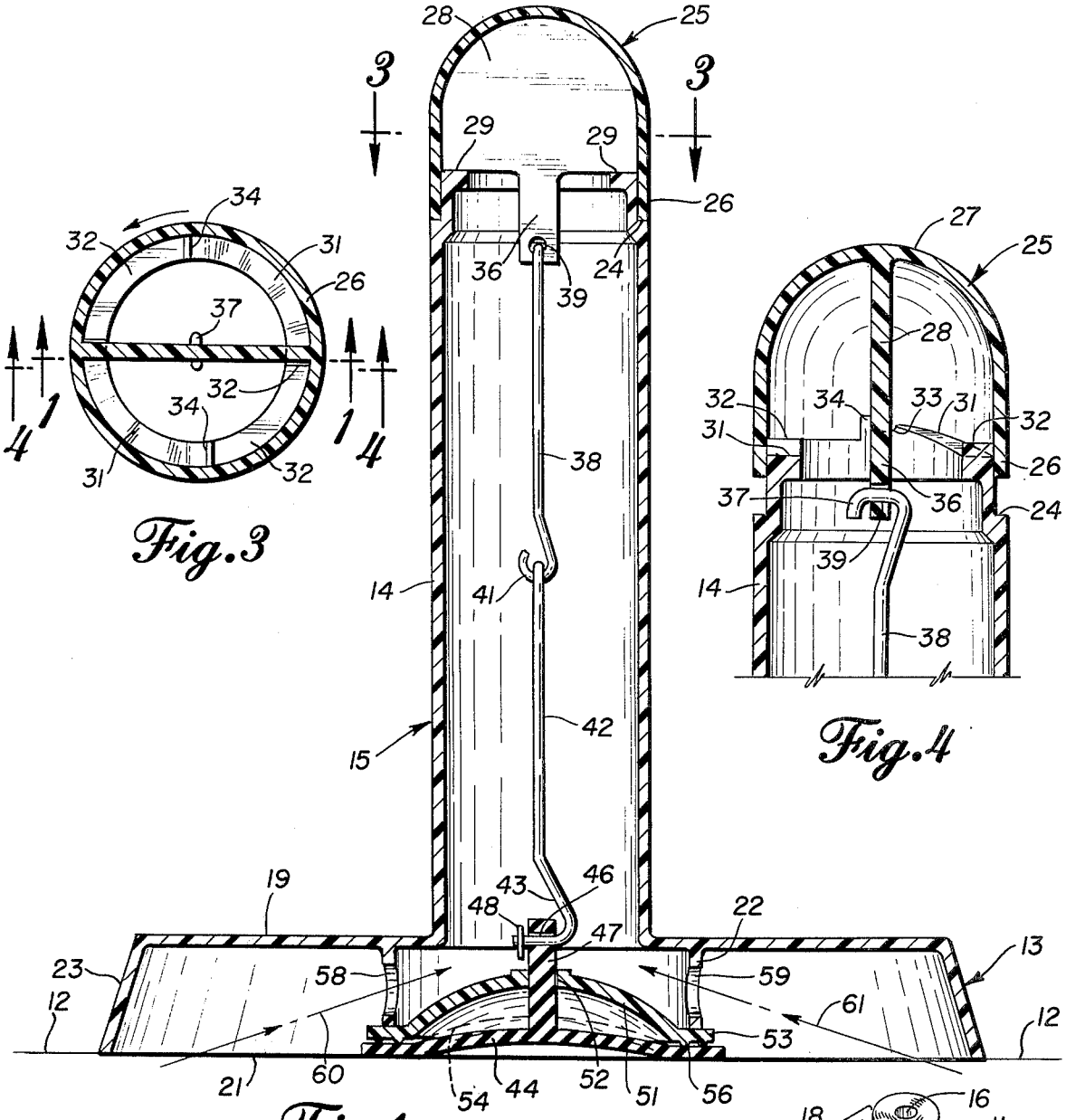
Fig.1
Fig.3
Fig.4
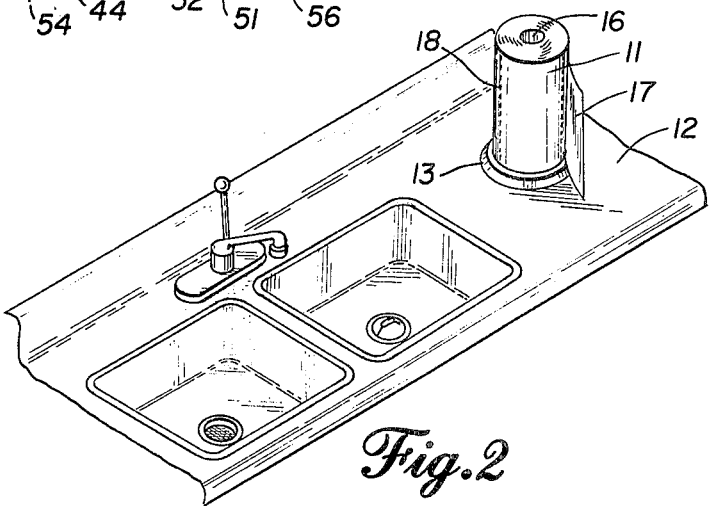
Fig.2

PAPER TOWEL HOLDER

BACKGROUND OF THE INVENTION

Many different types of dispensers have been provided to hold rolls of paper so that individual or multiple sheets of prescored paper may be separated from the roll for use. Paper towel holders usually provide a standard or mandrel on which the roll of towels is positioned. Holders that maintain the roll of paper towels and its core horizontally disposed are predominant. Previous arrangements utilizing horizontally disposed roll supports and suction cup elements for support of the mandrel are acknowledged, at least in the toilet paper dispenser categories. Paper towels present a separate and distinct problem by reason of the greater tearing force that must be applied to separate the towels from the roll and also by reason of the different characteristic user working positions when paper towels are to be used. Housewives and other users of paper towels can find it especially difficult to establish a convenient location for a towel dispenser of the type that holds the roll of towels in horizontal position. To provide desirable convenience of use and to avoid the cluttering of work spaces, rolls of paper towels are now often placed in upright position on countertops without support or confinement. This alternate loose countertop placement that can be handier and more convenient may still be troublesome, since two hands must be used to separate the towel segments from the roll.

SUMMARY OF THE INVENTION

The present invention provides a holder for paper towels that may be conveniently placed and held at any desired position on a countertop so that the roll will be held in upright position and so that individual towels can be torn from the roll in a one-hand operation. Structurally the holder provides a base having widely spaced support sidewalls and a standard for closely engaging the interior of the tube core of the roll in a manner that will limit but not necessarily permit rotation of the roll when towels are being unwound therefrom. A suction cup that is disposed for contact with the supporting surface for the holder is positioned within the base, and a mechanism is provided on the holder that will move the center of the suction cup toward and away from the supporting surface as necessary to create and release the vacuum influences that are used to hold the paper towel holder at selective positions on the supporting surface. The wide base that is held in contact with the supporting surface by such vacuum influences itself prevents tilting of the holder and its standard, and, accordingly, the lateral forces that tend to dissipate vacuum influences in other suction cup usages are avoided.

In a preferred embodiment of the invention, a cam or inclined plane type of mechanical advantage mechanism is disposed at the top of the upright standard, and the mechanism is interconnected to the suction cup by centrally disposed rods that move translationally to create and relieve vacuum influences in the suction cup. Further features of the invention are presented in the accompanying description and by the drawings.

BRIEF DESCRIPTION OF THE DRAWINGS

FIG. 1 is a partially offset cross-sectional elevation of a preferred embodiment of the paper towel holder construction, FIG. 2 is a perspective drawing showing preferred use of the device to support a roll of paper towels in the upright position, FIG. 3 is a cross-sectional plan view taken along the line 3—3 of FIG. 1, and FIG. 4 is a cross-sectional elevation taken from the same direction as that of FIG. 1 but with the operator cap for the holder rotated 90°.

DESCRIPTION OF THE PREFERRED EMBODIMENTS

Details of construction for a preferred embodiment are shown in FIGS. 1 through 4. This towel holder embodiment is intended primarily for use to hold rolls of paper towel 11 in upright position above a countertop 12 or similar work support surface. The base 13 of the towel holder 15 engages the countertop 12, and the central support standard 14 for the holder 15 is disposed at right angles to the base and is, accordingly, in an upright position. When the towel holder is so positioned and held on a countertop 12, a tube core 16 of the paper roll 11 will be engaged about the exterior surface of the standard 14, and it will itself be disposed in upright position. With such a work installation and arrangement, individual sheets of paper towel 17 may be torn from the roll supply 11 along the provided prescore lines 18.

Distinctive features of the present embodiment of the invention are involved in providing a towel holder 15 that can be used in the illustrated manner to support a roll supply of towels at selective positions that are closely adjacent to a work station. Installations wherein the support standard will be disposed horizontally or at other angles are possible but are not of primary interest. Accordingly, the components and elements of the invention are described primarily for use in the upright condition. For the preferred embodiment shown in FIGS. 1, 3 and 4 the base 13 for the towel holder 15 is hollow. A sidewall 23 of truncated right conical shape is formed integrally with a flat plate section 19 to provide the main structure for base 13. A lower contact edge 21 for the sidewall 23 is adapted for engagement with the supporting countertop 12 or other work surface. The sidewalls 23 are of substantial diameter as compared to the exterior diameter for the standard 14, and, accordingly, a wide and inherently stable type of support is provided. Since the drawings are of approximate actual size, it can be observed that the width of the base is approximately equal to the effective height for the standard 14.

For the illustrated embodiment of the invention, the base 13 and standard 14 are of an integral construction that can include a central ring 22 if injection or mold formed of plastic type materials. The standard 14 that is derived from such manufacturing process is of a generally hollow cylindrical construction that is of reduced size adjacent its top end to provide a shoulder 24. Shoulder 24 is provided to receive the downwardly extending exterior cylindrical skirt 26 of operator cap 25. The cap itself is preferably of a dome shape having a top curved surface 27 that will center and guide the tube core 16 of a paper roll 11 as it is being applied to the paper holder 15. The top surfaces of standard 14 operate cooperatively with lower surfaces of a diaphragm segment 28 disposed within the dome cap 25. Lower follower edges 29 of the diaphragm segment 28 engage cam and stop segments 31 and 32 provided interiorly of the standard 14 and at the top surface thereof. The cam surfaces 31 rise gradually on an inclined plane from an elevation less than the elevation for the stop 32 to an elevation that is above the stop surfaces 32.

At their upper extent the cams 31 have notches 33 disposed adjacent stop shoulders 34. When the cap 25 is rotated in a proper direction, the follower surfaces 29 of the diaphragm segment 28 will move axially away from the base 13 as they move up the cam surfaces 31. Total rotational movement of the cap 25 is limited to ninety degrees, and the follower surfaces 29 become engaged in the notches 33 and against the shoulder stops 34 at the upper limit of travel. When the cap is rotated in reverse direction, the follower surfaces 29 move axially toward the base until the diaphragm segment comes against the upstanding stop surface 32. As the cap is rotated in the manner described, the skirt 26 thereof will move away from the shoulder 24, but the cap will not become loose from the standard 14. A tab 36 is provided on diaphragm segment 28 to extend downwardly into the interior of the standard 14. The hook end 37 of an upper operator rod 38 extends through a hole 39 provided in tab 36. A lower hook end 41 of operator rod 38 engages a similar hook end on a lower rod 42, while the lowest end of the rod 42 has an angle extension 43 that is engaged to a flexible diaphragm element 44 of the suction cup components of the device. Actually the angle end 43 passes through an opening 46 in a stem 47 of the diaphragm suction cup element 44. A clip 48 is provided to hold the angle end 43 engaged to the stem 47 of diaphragm piece 44.

In order to assure good initial contact between the suction cup diaphragm 44 and a supporting surface, such as the surface of countertop 12, a cup support piece of dome shape 51 is used. This element, which may itself be formed of plastic material, has a central guide opening 52 through which the stem 47 extends. At its lower edge the dome cup 51 flares outwardly to provide a flat disk shape 53 having raised circular ribs 56 on its lower surface. These ribs 56 are held by the central ring 22 and the structure of the cup support 51 in contact with the flexible diaphragm piece 44 to hold such suction cup diaphragm in contact with the desired support surface 12. With the foregoing arrangement, ninety degree rotation of the operator cap 25 causes the rods 38 and 42 to exert an axially directed force on the diaphragm 44 that will cause it to be moved to the alternate position indicated by the lines 54. With such movement vacuum influences will be created in the space beneath the suction cup diaphragm 44, and the resulting force will tend to hold base 13 and its sidewall base edges securely in contact with the horizontal supporting surface 12. The hook ends 37 and 41 provided on the rods 38 and 42 are loosely engaged, and, accordingly, a full 90° rotation can be accommodated. Rotation greater than 90° is limited by the stop surfaces 32 and stop shoulders 34, and, accordingly, an assembled device cannot be rotated more than 90°. Excess movement and destructive elongations cannot be exerted against the suction cup diaphragm 44. Openings 58 and 59 are provided in the central ring 22 in order to facilitate assembly of the device. The lower angle end 43 for the rod 42 can be observed through the opening 59 as such angle end is inserted through the opening 46 of stem 47. A tool can be inserted through the opening 58 to engage or disengage the clip 48 on the angle end 43 to complete the assembly. Lines of access for such connective assembly operations are indicated by the lines 60 and 61.

I claim:

1. A holder for tube core types of roll paper towels adapted for selective positioning and mounting on a flat support surface adjacent user work stations comprising a base element having planar contact surfaces for engaging said support surface at widely spaced apart positions, a standard disposed in normal position with respect to said base and of exterior size for close engagement with the interior of said tube core whereby relative rotation as between said tube core and said standard is frictionally resisted, said base providing a recess therein intermediate opposed contact surfaces of said base, a suction cup within said recess having its outer edges disposed in planar positions with respect to the contact surfaces of said base and, accordingly, in position for contact with said support surface, said suction cup further being isolated and free of major torsion forces that may be exerted by and on said base and standard, actuator means on said standard inclusive of an output element providing translational relative motion with respect to said base and suction cup and, accordingly, directed toward and away from said support surface, and connector means for the transmission of tension loadings joining the said output element for said actuator means and said suction cup whereby vacuum influences are relieved and induced beneath said suction cup for selectively holding the suction cup and, accordingly, said holder and the contact surfaces thereof securely on said support surface at adjusted positions.

2. The paper towel holder as set forth in claim 1 wherein said base and standard are formed unitarily with said base recess being disposed centrally thereof and further comprising a central ring structure within said recess and extending toward the outer edges of said suction cup for holding the cup edges in contact with said support surface.

3. The paper towel holder as set forth in calim 2 and further comprising a structurally separate suction cup support piece intermediate said cup and said central ring structure for holding the outer edges of the suction cup in contact with said towel holder support surface.

4. The paper towel holder as set forth in claim 1 wherein said base and standard are hollow with the output element of said actuator means and said connector means being disposed interiorly of said standard and with said connector means further transmitting only tension loadings to said suction cup.

5. The paper towel holder as set forth in claim 4 wherein said actuator means is disposed at the top of said standard and further comprising an inclined plane element providing the translational relative motion for the output element of said actuator means.

6. The paper towel holder as set forth in claim 5 wherein said actuator means is an operator cap rotatably mounted on said standard with said inclined plane element being disposed operatively between said cap and said standard whereby the cap and the output element are moved reciprocally toward and away from said base.

7. The paper towel holder as set forth in claim 6 wherein said inclined plane element includes mating cam surfaces disposed circumferentially on said cap and standard and further comprising stop members for limiting rotary movement operations of said cap.

8. The paper towel holder as set forth in claim 7 wherein the output element of said actuator means is a tab depending centrally from said cap and wherein said connector means comprises an operator rod extending from said tab, and hook ends on said rod for loose engagement to provide limited rotary freedom of motion for said operator rod and cap.

9. The paper towel holder as set forth in claim 7 wherein said connector means is of multi-link construction.

* * * * *